US007086881B2

(12) United States Patent
Fan

(10) Patent No.: US 7,086,881 B2
(45) Date of Patent: Aug. 8, 2006

(54) ELECTRICAL CONNECTOR

(75) Inventor: Chia Hao Fan, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/028,129

(22) Filed: Dec. 31, 2004

(65) Prior Publication Data

US 2005/0282418 A1 Dec. 22, 2005

(30) Foreign Application Priority Data

Jun. 18, 2004 (TW) ..... 93117596 A

(51) Int. Cl.
*H01R 13/44* (2006.01)

(52) U.S. Cl. ..... 439/142

(58) Field of Classification Search ..... 439/137, 439/138, 141, 76.1
See application file for complete search history.

(56) References Cited

U.S. PATENT DOCUMENTS

| | | | | |
|---|---|---|---|---|
| 6,832,923 | B1 * | 12/2004 | Sasame et al. | 439/137 |
| 6,877,994 | B1 * | 4/2005 | Huang | 439/76.1 |
| 6,948,954 | B1 * | 9/2005 | Fan | 439/137 |
| 2002/0177336 | A1 * | 11/2002 | Sasame et al. | 439/142 |
| 2003/0077929 | A1 | 4/2003 | Funatsu | |
| 2003/0148645 | A1 * | 8/2003 | Hashimoto | 439/137 |
| 2004/0067667 | A1 * | 4/2004 | Kuroki | 439/138 |
| 2004/0092145 | A1 * | 5/2004 | Sasame et al. | 439/137 |
| 2004/0229483 | A1 * | 11/2004 | Uchida | 439/137 |

FOREIGN PATENT DOCUMENTS

| | | |
|---|---|---|
| JP | 2000-36355 | 2/2000 |
| TW | 487234 | 5/2002 |
| TW | 557003 | 10/2003 |

* cited by examiner

*Primary Examiner*—Tulsidas C. Patel
*Assistant Examiner*—Harshad C Patel
(74) *Attorney, Agent, or Firm*—Wei Te Chung

(57) ABSTRACT

An electrical connector comprises an insulating case, a plurality of electrical contacts received in the insulating case, a shutter member mounted on the insulating case and an elastic piece. The insulating case defines a longitudinal direction and comprises a receiving space, a plug fitting section locate beside the receiving space. The shutter member is mounted on the insulating case and comprises a base section movable with respect to the insulating case to close and open the plug fitting section of the insulating case and a mating section extending from the base section into the receiving space to secure with a second mating section. The elastic piece provided in the receiving space and connected with the shutter member to drive the shutter member to elastically close and open the plug fitting section of the insulating case.

20 Claims, 8 Drawing Sheets

ELECTRICAL CONNECTOR

BACKGROUND OF THE INVENTION

1. Field of the Invention

The present invention relates to an electrical connector, more particular, to an electrical connector that has means for preventing dust and dirt from entering into it.

2. Description of Related Art

In order to achieve power or signal transmission, various kinds of electrical connectors are generally used to connect internal components within electrical devices and connect an electrical device with other devices. However, in untidy condition, especially when electrical connectors are not fitted, dust and dirt may enter into the electrical connector to adversely effect against power or signal transmission.

At present, in order to solve the above-mentioned problem, a shutter member is designed on a plug fitting section of a connector. U.S. patent application Pub. No. 2004/0092145 discloses a receptacle connector with a shutter member. A locking portion of the shutter member, a spring member and shafts are formed outside of the longitudinal length of a housing of the receptacle connector and are easily destroyed before the receptacle connector is soldered on a printed circuit board. Moreover, the shutter member is rotatably supported by shafts provided on side walls of a housing of the receptacle connector. However, repeated rotation of the shutter member about the shafts may result in abrasion of the shafts, because the shafts are made of insulating material and the shutter member is made of metal, thereby, decreasing a using lifetime of the receptacle connector.

Therefore, it is desirable to provide an electrical connector to overcome the above problems.

SUMMARY OF THE INVENTION

The object of the present invention is to provide an electrical connector with shafts of metal which have well abrasion resistance, so as to increase lifetime of the electrical connector.

Another object of the present invention is to provide an electrical connector comprising mating arms formed on a shutter member, an elastic piece and a shaft and which are formed within the longitudinal length of an insulating case of the electrical connector, so as to protect the electrical connector form damage.

In order to achieve the object set forth, the electrical connector according to the present invention comprises an insulating case, a plurality of electrical contacts received in the plug fitting section of the insulating case, a shutter member mounted on the insulating case and an elastic piece. The insulating case defines a longitudinal direction and comprises a receiving space, and a plug fitting section located beside the receiving space along the longitudinal direction. The shutter member is mounted on the insulating case and comprises a base section movable with respect to the insulating case to close and open the plug fitting section of the insulating case and a mating section extending from the base section into the receiving space to secure with a second mating section. The elastic piece provided in the receiving space and connected with the shutter member to elastically drive the shutter member to close the plug fitting section of the insulating case.

The detailed features of the present invention will be apparent in the detailed description with appropriate reference to the accompanying drawings.

DETAILED DESCRIPTION OF THE INVENTION

The present invention is now described in detail.

Figure 1:
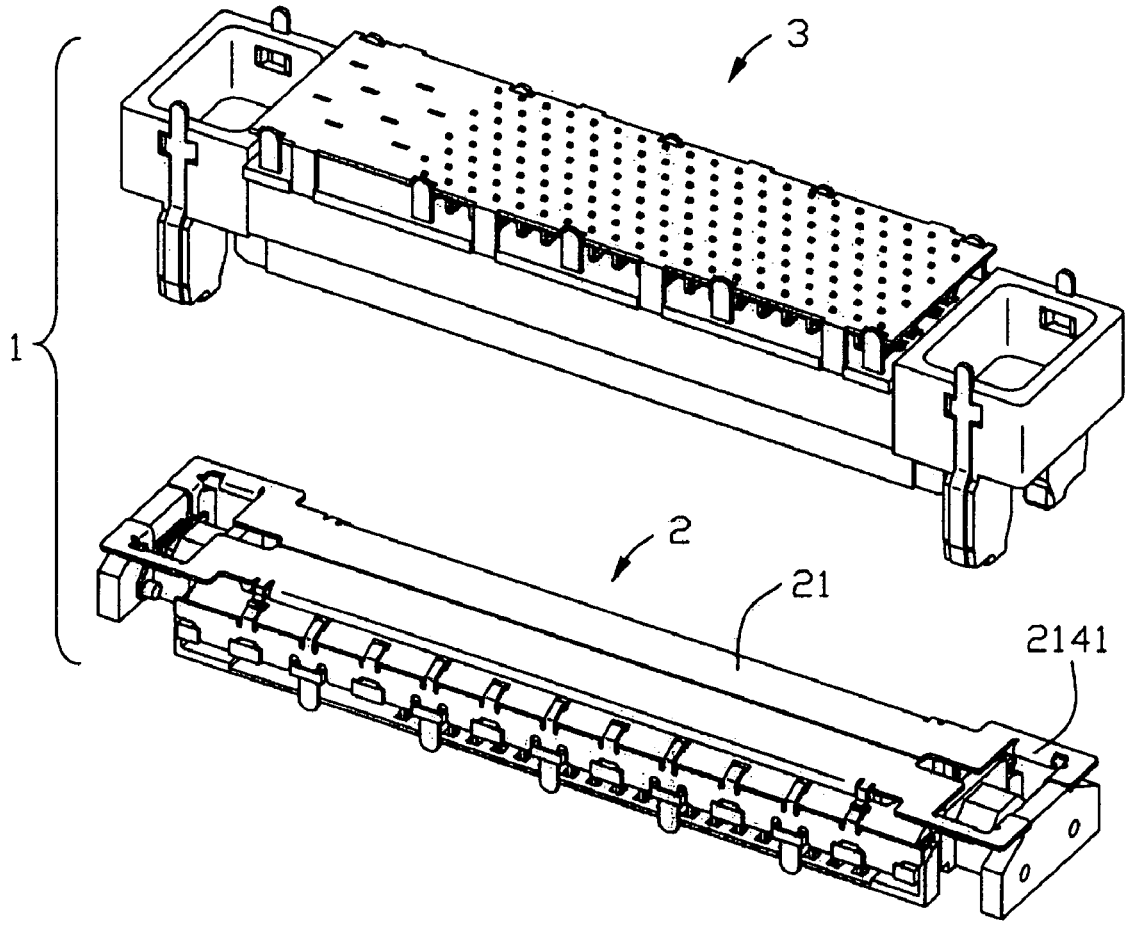
FIG. 1 is a perspective view of a receptacle connector according to the present invention and a plug connector for mating with the receptacle connector.

In FIGS. 1–9, an electrical connector assembly 1 comprises a receptacle connector 2 according to the present invention and a plug connector 3 to be connected to the receptacle connector 2. As shown in FIG. 1, the receptacle connector 2 provides a shutter member 21 in order to prevent dust and dirt from entering into the receptacle connector 2.

Figure 2:
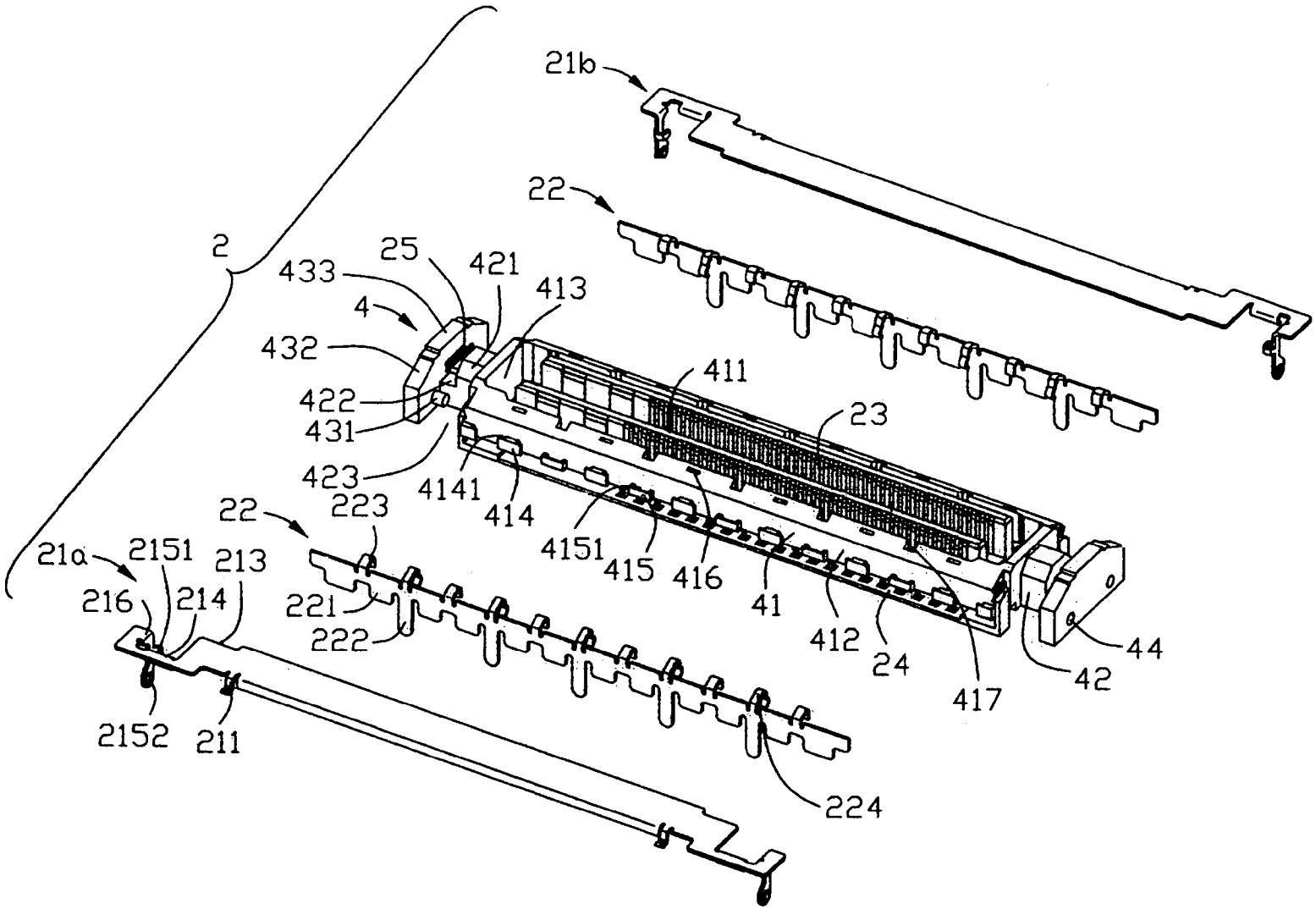
FIG. 2 is an exploded perspective view of the receptacle connector in FIG. 1.
Figure 4:
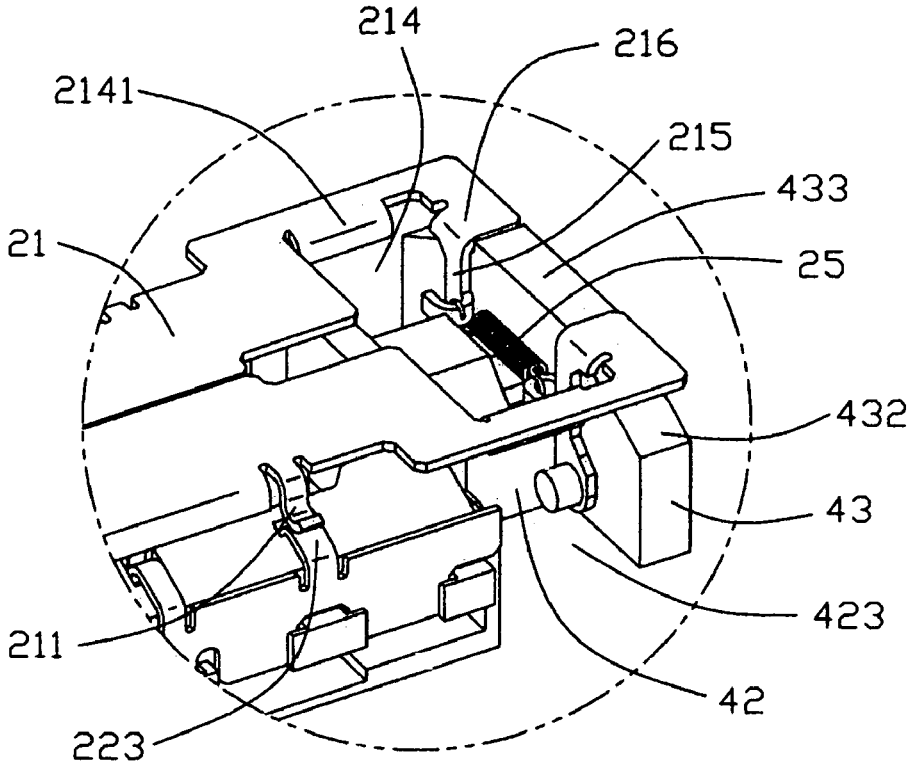
FIG. 4 is a partially enlarged perspective view of the receptacle connector shown in FIG. 2, but taken from another aspect.

As shown in FIGS. 2 and 4, the receptacle connector 2 comprises a first insulating unitary elongate case 4, a pair of first shielding covers 22 mounted on the outer periphery of the first insulating case 4 and a shutter member 21. The first insulating case 4 comprises a first base portion 41, a pair of neck portions 42 extending from opposite ends of the first base portion 41 and a pair of wall portions 43 extending from the pair of neck portions 42. The first base portion 41 is provided with a first bottom board 24 mounted thereon and has a groove along the longitudinal direction of the insulating case 4. The groove has a pair of side walls 412 at opposite sides thereof and a pair of first plug fitting section 411 protrude into the groove accommodating a plurality of first electrical contacts 23 at opposite sides thereof. Two separate through-holes 413 are set on ends of the groove. The plurality of first electrical contacts 23 extends downwards through the first bottom board 24 to connect with a printed circuit board. A plurality of first convexities 414 and a plurality of second convexities 415 are alternatly arranged at intervals along an outer periphery of the pair of side walls 412. The first convexties 414 further comprise blocks 4141 and the second convexities 514 further comprise slots 4154. A gap 416 and a passage 417 are provided on an upper surface of the side walls 412 at intervals along the longitudinal direction. In addition, a top of the neck portion 42 is flanked by a pair of guide planes 421. A spring 25 is mounted on a concave 422 provided between the neck portion 42 and the wall portion 43 and connected with the shutter member 21 to elastically drive the shutter member 21 to close the plug fitting section 411 of the insulating case 4. The wall portion 43 is a board perpendicular to the longitudinal direction. For a width of the neck portion 42 perpendicular to the longitudinal direction is smaller than a corresponding width of the first base portion 41, there is a receiving space 423 defined between the first base portion 41 and the wall portion 43 and adjacent to the neck portion 42. A pair of sliding faces 432 respectively extends downwards from the top of the wall portion 43. Otherwise, step portion 433 is formed on the top of the sliding face 432 and symmetrically arranged about the central line of the shutter member 21. Two shafts 431 are provided on the wall portion 43 to extend into the receiving space 423 so as to mount the shutter member 21.

Figure 6:
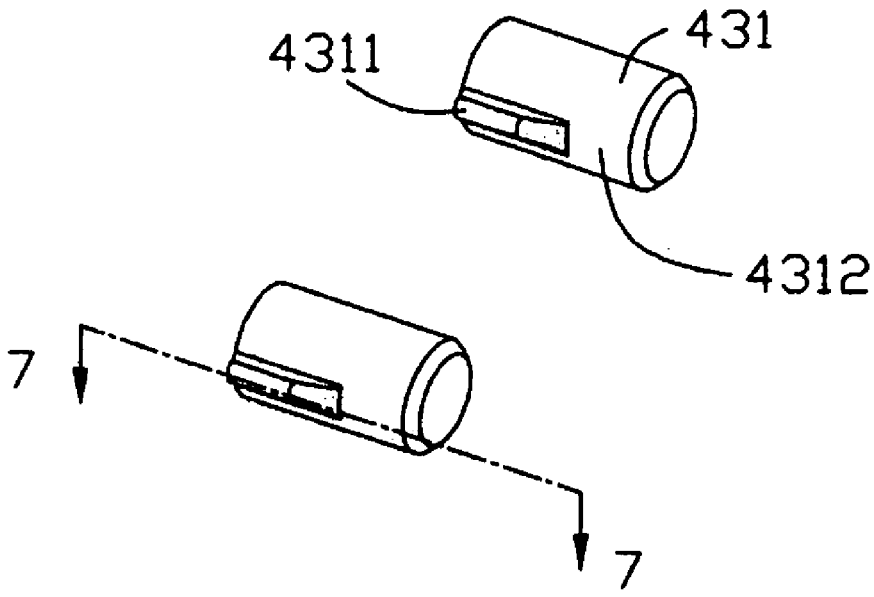
FIG. 6 is enlarged perspective view of shafts of the receptacle connector shown in FIG. 2.
Figure 7:
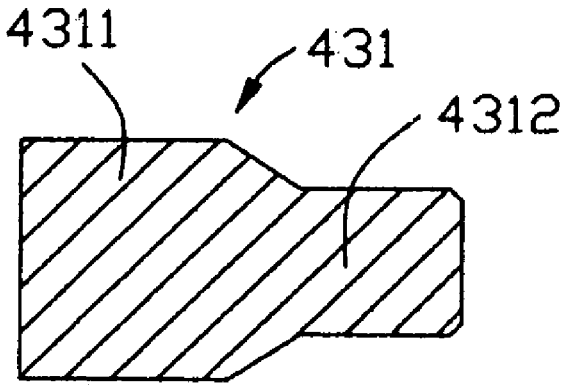
FIG. 7 is a cross-sectional view taken along line of 7—7 of FIG. 6.
Figure 8:
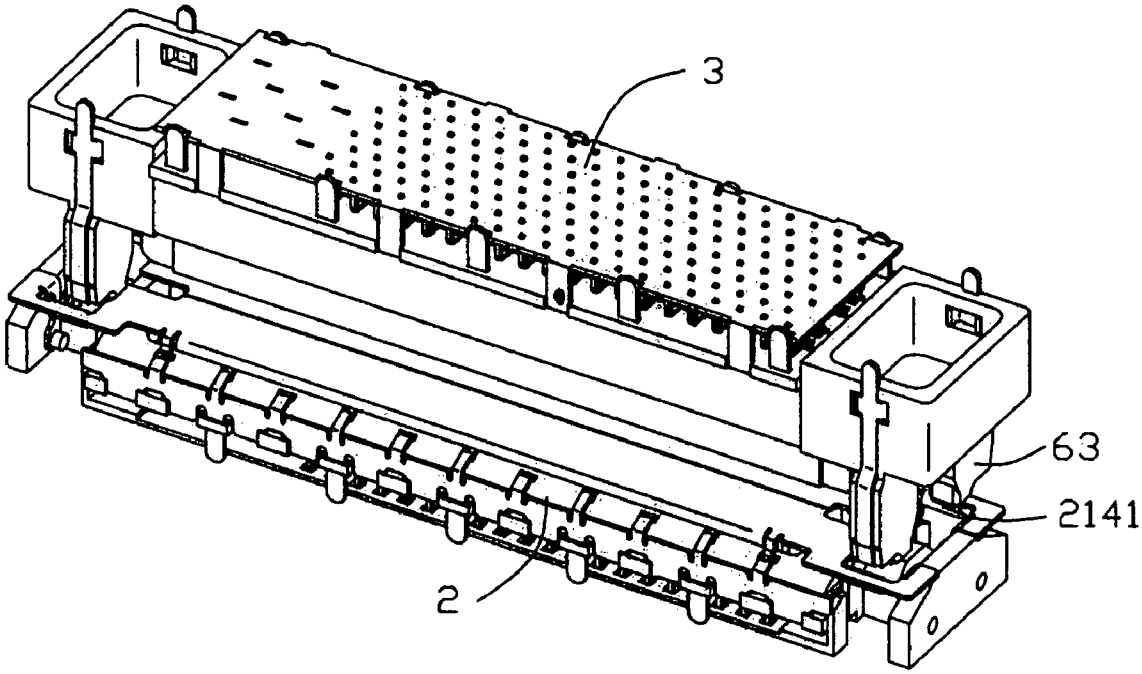
FIG. 8 is a perspective view showing the plug connector not completely mating with the receptacle connector.
Figure 9:
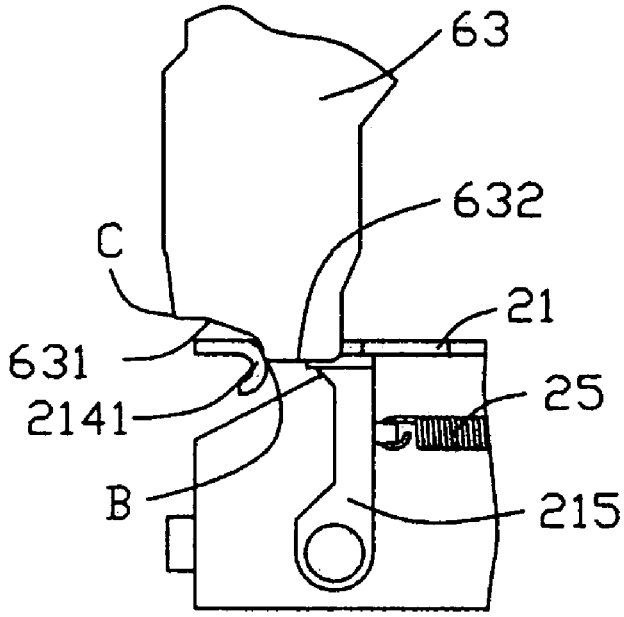
FIG. 9 is a planar view showing guide pins of the plug connector partially enters a shutter member of the receptacle connector.
Figure 10:
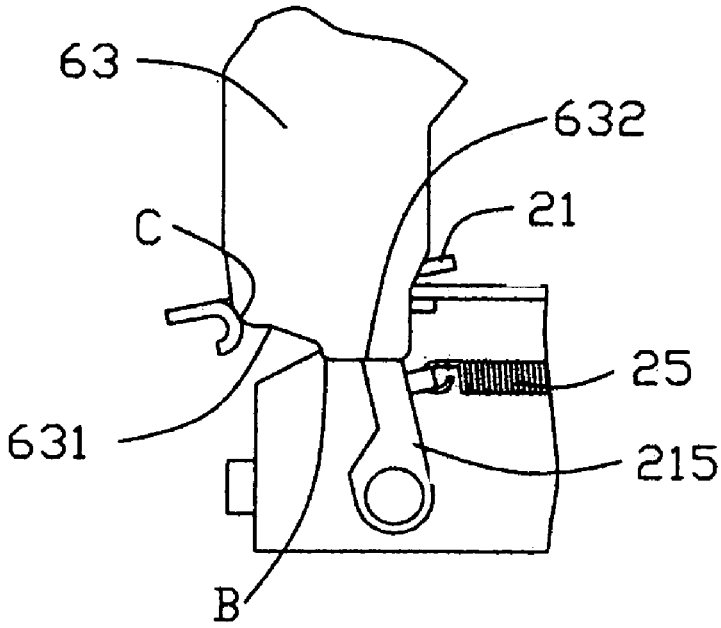
FIG. 10 is a view similar to FIG. 9 showing the guide pins of the plug connector completely enters the shutter member of the receptacle connector.
Figure 11:
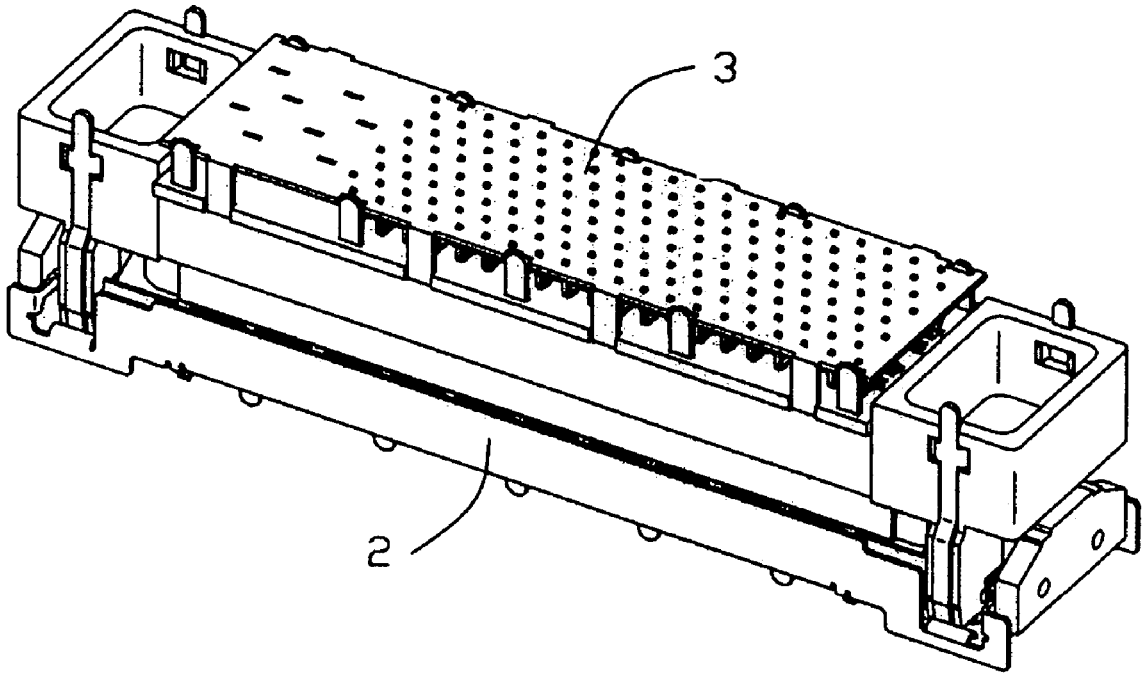
FIG. 11 is a view similar to FIG. 8 showing the plug connector completely mates with the receptacle connector.

Referring to FIGS. 6 and 7, the shafts 431 are column-shaped and made of metal. A securing portion 4311 is provided on a surface of one end of the shaft 431 and the securing portion 4311 is a convex rib with guidable side, on the other hand, a rolling portion 4312 is formed on the spare surface of the shaft 431. When the securing portion 4311 is secured into the holes 44, the rolling portion 4312 is exposed out of the receiving space 423.

Then, referring to FIGS. 2 and 4, the pair of first shielding covers 22 is formed and stamped from a metal sheet and configured in an elongated shape. Each of the first shielding covers 22 comprises a plurality of fixing pieces 221 and a plurality of first grounding pieces 222 extending downwards from a lower edge thereof arranging at intervals, a plurality of contact pieces 223 and elastic contact pieces 224 curving upwards from an upper edge thereof at intervals. When the pair of first shielding covers 22 are mounted on the first base portion 41, the fixing pieces 221 are inserted into a space between the first convexities 414 and the second convexities 415 and are secured by the blocks 4141. At the same time, the first grounding pieces 222 are inserted into the slots 4151 and extend downward to connect with the grounding wire of a printed circuit board, also, the contact pieces 223 are fixed into the gap 416 and the forepart of the elastic contact pieces 224 are received into the passage 417.

The shutter member 21 comprises a pair of shutter member halves 21*a*, 21*b* of metal. As the halves 21*a*, 21*b* are substantially symmetrical, a description will be given of the first half 21*a* with the understanding that the second half 21*b* is of substantially similar configuration. The first half 21*a* comprises a base section. Two separate recesses 214 are provided on opposite ends of the base section of the first half 21*a* and two smaller recesses 213 are adjacent to the recesses 214. For the two separate recesses 214 are the same, one recess 214 is described. A curving piece 2141 curves downwards from one side to the opening of the recess 214 (FIG. 1). A mating arm 215 is extending downwardly from a distal end 216 which is perpendicular to a surface of the base section of the first half 21*a*. Further, a locking portion 2151 protrudes from an edge of the mating arm 215 to the curving piece 2141 and a pivot hole 2152 is provided in free end of the mating arm 215. Otherwise, guide pieces 211 extend downwardly from one edge of the base section of the first half 21*a*. Specially, the opening direction of the recesses 214, 213 is different from the protruding direction of the guide pieces 211. As shown in FIG. 1, when the pivot hole 2152 of the first half 21*a* is secured on the shaft 431 of the first insulating case 4, the spring 25 is secured with the responding locking portion 2151. Under certain force, the shutter member 21 is able to close and open the first plug fitting section 411 of the receptacle connector 2. When the shutter member 21 is closed, the opening formed by the two smaller recesses 213 of the shutter member halves 21*a*, 21*b* communicates with the through-hole 413, the opening formed by the two recesses 214 of the shutter member halves 21*a*, 21*b* communicates with the receiving space 423. Simultaneously, the distal ends 216 abut against the step portions 433 and the guide pieces 211 meet the contact pieces 223 of the first shielding covers 22. As a result, dust and dirt can not enter into the first plug fitting section 411 to contaminate the first electrical contacts 23. On the other hand, while the shutter members 21 open the first plug fitting section 411, the guide pieces 211 are sliding along the contact pieces 223.

Figure 3:
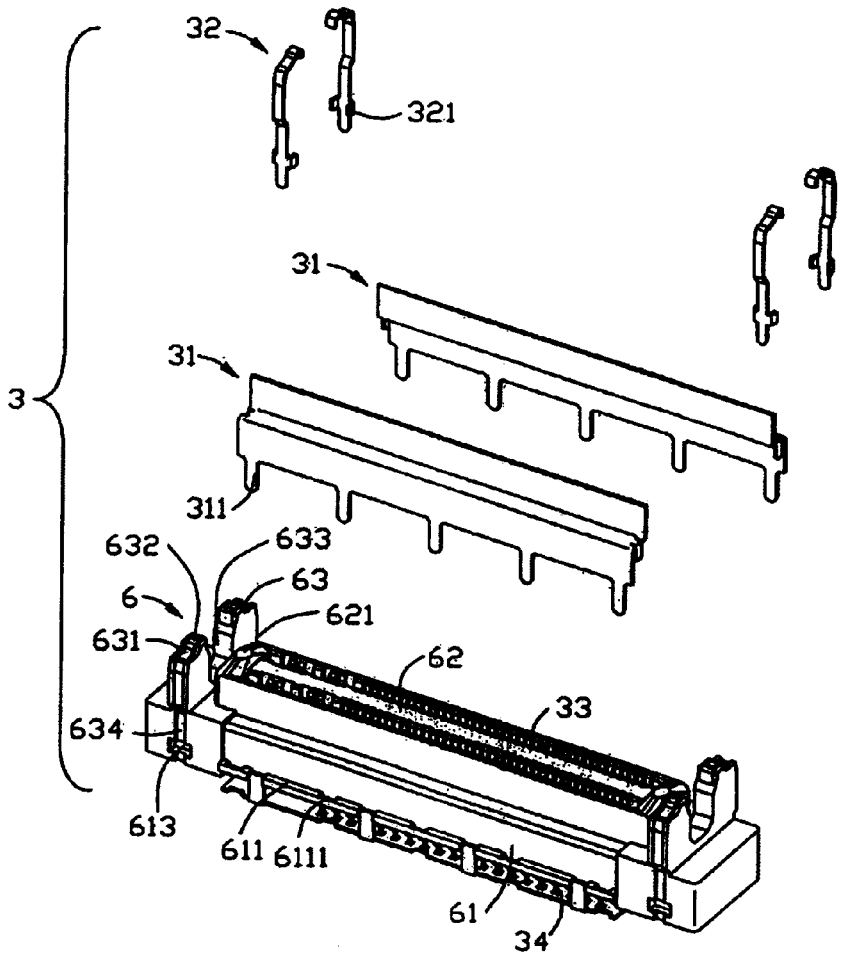
FIG. 3 is an exploded perspective view of the plug connector in FIG. 1.

Then, referring to FIG. 3, the plug connector 3 consists of a second insulating unitary elongate case 6, a pair of second shielding covers 31 mounted on an outer periphery of the second insulating case 6 and grounding contacts 32. The second insulating case 6 comprise a second base portion 61, a second plug fitting section 62 extending upwardly from the second base portion 61 and a pair of separate guide devices 63. A plurality of slots 6111 is located on a pair of ribs 611 extruding from opposite sides of the second base portion 61. The second plug fitting section 62 is provided with a second bottom board 34 mounted thereon and has a groove along the longitudinal direction. The second plug fitting section 62 protrudes into the groove accommodating a plurality of second electrical contacts 33 at two sides thereof. The plurality of second electrical contacts 33 extends downwardly through the second base portion 61 and the second bottom board 34 to connect with a printed circuit board. Furthermore, a pair of separate guide tapers 621 extends upwardly from opposite ends of the second plug fitting section 62 to connect with the first plug fitting section 411 of the receptacle connector 2. In addition, the guide devices 63 extended from the second base portion 61 are adjacent to the guide tapers 621 at the same direction of the second plug fitting section 62 and the guide tapers 621. On the other hand, a plurality of second grounding pieces 311 extends downwards from the low edge of the second shielding covers 31 and is inserted into the slots 6111 of ribs 611 of the second base portion 61 so as to connect to the ground.

Figure 5:
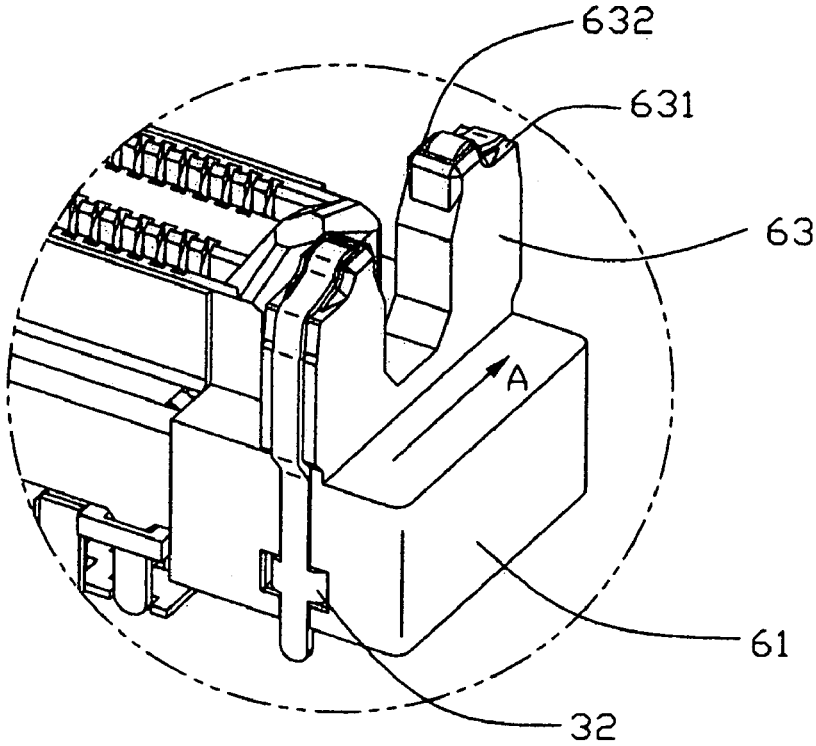
FIG. 5 is a partially enlarged perspective view of the plug connector shown in FIG. 3.

As shown in FIGS. 3 and 5, each of the guide devices 63 has a pair of guide columns. The guide columns are saddle shape and extend perpendicularly to the direction of the arrow A and arranges symmetrically at a distance. Because the pair of guide columns is the same structure, so one of the guide columns is described. The guide column comprises a peak 632, a slant 631, a long groove 634 and an inner surface 633. The slant 631 is located in flank of the guide column and slopes up to form the peak 632. Furthermore, the long groove 634 extends from the peak 632 to a bottom of the second base portion 61 and a longitudinal securing portion 613 of the second base portion 61 is provided on the free end of the long groove 634 and the width of which is more than that of the long groove 634. Both the peak 632 and the slant 631 are located in the long groove 634. When the grounding contact 32 of metal material is fitted on the second base portion 61, the grounding contact 32 is secured in the long groove 634 and a bender 321 is provided at the free end of the grounding contact 32 and is secured in the longitudinal securing portion 613 of the second base portion 61. On the other hand, the inner surface 633 of the guide column matches with the surface of the neck portion 42 of the first insulating case 4.

Referring to FIGS. 8–11, when the plug connector 3 is plugged into the receptacle connector 2, firstly, the peak 623 of the guide device 63 enters into the recess 214 and contacts the curving piece 2141 at the point of B. At the moment, static electricity of the plug connector 3 and the receptacle connector 2 is released through the grounding contact 32, the curving piece 2141, the guide piece 211 and the contact piece 223 of the first shielding cover 22. However, in this moment the second plug fitting section 62 does not contact with the first plug fitting section 411 and the second electrical contacts 33 also does not contact with the first electrical contacts 23. Secondly, the slant 631 of the guide device 63 slides on the curving piece 2141 to the point of C to drive the mating arm 215 to rotate about the shaft 431 and the spring 25 is elongated at the same time. Meanwhile, the guide piece 211 slides on the contact piece 223 so that the second plug fitting section 62 is entirely connected to the first plug fitting section 411. Especially, when the guide column of the guide device 63 moves to the point of C, the transverse width of the guide column accelerates so as to open the shutter members 21 rapidly. To disconnect the first plug fitting section 411 from the second plug fitting section 62, the receptacle connector 2 is disconnected from the plug connector 3. That is to say, when the plug connector 3 is lifted up from the receptacle connector 2, the guide pins 63 come out of the receiving space 423 and the shutter member 21 is closed to be driven by the spring 25. Especially, the step portions 433 can prevent the shutter sheet 21*a* from coming into collision with the shutter sheet 21*b* and resulting in suffering destruction as a result of release of the spring 25. Otherwise, the guide pieces 211 can cushion the collision between the shutter sheets 21*a*, 21*b* for sliding on the contact pieces 223.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulating case defining a longitudinal direction and comprising a receiving space, and a plug fitting section located beside the receiving space along the longitudinal direction;

a plurality of electrical contacts received in the plug fitting section of the insulating case;

a shutter member mounted on the insulating case and comprising a base section movable with respect to the insulating case to close and open the plug fitting section of the insulating case and a mating section extending from the base section into the receiving space to secure with the insulating case; and an elastic piece provided in the receiving space and connected with the shutter member to elastically drive the shutter member to close the plug fitting section of the insulating case.

2. The elecuical connector according to claim 1, wherein the receiving space is provided with a second mating section engaging with the mating section.

3. The electrical connector according to claim 2, wherein the insulating case comprises a base portion and a wall portion.

4. The electrical connector according to claim 3, wherein the base portion is formed with a neck portion on at least one end thereof and between the base portion and the wall portion, and wherein a width of the neck portion perpendicular to the longitudinal direction is smaller than a corresponding width of the base portion, the elastic piece is provided in the receiving space above the neck portion and the second mating section is in the receiving space adjacent to the neck portion.

5. The electrical connector according to claim 4, wherein the neck portion comprises a concave located inside of the receiving space, the elastic piece is mounted in the concave.

6. The electrical connector according to claim 5, wherein the concave is located on the neck portion adjacent to the wall portion, and wherein the second mating portion is provided on the wall portion.

7. The electrical connector according to claim 5, wherein the concave is located on the neck portion adjacent to the base portion. and wherein the second mating section is provided on the base portion.

8. The electrical connector according Co claim 3, wherein a top of the wall portion is formed with a step portion, and wherein the shutter member lean against the step portion when the shutter member closes.

9. The electrical connector according to claim 2, wherein the shutter member comprises a mating arm extending from the base section into the receiving space and the mating section is provided on the mating arm.

10. The electrical connector according to claim 9, wherein the mating section is a pivot hole and the second mating section is a shaft.

11. The electrical connector according to claim 1, wherein the shutter member comprises a pair of lengthwise shutter member halves and each of the lengthwise shutter member halves comprises a locking portion to connect with one end of the elastic piece.

12. The electrical connector according to claim 1, wherein a plug connector for mating with the electrical connector comprises a guide device driving the shutter member to open the plug fitting section.

13. The electrical connector according to claim 2. wherein the shutter member is made of metal, and wherein the second mating section is a metallic shaft.

14. The electrical connector according to claim 13, wherein the insulating case comprises at least one hole, and wherein the metallic shaft is secured into the hole and extends into the receiving space.

15. The electrical connector according to claim 14, wherein the shaft comprises a securing portion secured into the hole and a rolling portion exposed out of the bole.

16. The electrical connector according to claim 15, wherein the securing portion is a convex rib on a surface of the shaft.

17. The electrical connector according to claim 1, further comprising shielding covers mounted on the insulating case.

18. The electrical connector according to claim 1, further comprising a bottom board, and wherein the plurality of electrical contacts extends downwards through the bottom board and adjacent to connect with a printed circuit board.

19. An electrical connector assembly comprising:

a first connector including:

first insulative housing defining a mating opening in a vertical direction and a cavity at one lengthwise end thereof;

a plurality of first contacts disposed in the first housing in communication with said mating opening;

a shutter defining a mating arm pivotally secured around an inner wall of the housing facing said cavity, and an elongated ceiling covering said mating opening; and a second connector including:

a second insulative housing defining a post at one lengthwise end thereof;

a plurality of second contacts disposed in the second housing; wherein when the first connector and the second connector are mated with each other, the post is inserted into the cavity and cooperates with the inner wall to sandwich said mating arm therebetween in a lengthwise direction.

20. An electrical connector assembly comprising:

a first connector including;

first insulative housing defining a mating opening in a vertical direction and a cavity at one lengthwise end thereof;

a plurality of first contacts disposed in the first housing in communication with said mating opening;

a shutter defining a mating arm pivotally secured in said cavity, an abutment section adjacent to said mating arm and around the cavity, and an elongated ceiling relatively far from said mating arm and said abutment section to cover said mating opening; and a second connector including:

a second insulative housing defining a post at one lengthwise end thereof;

a plurality of second contacts disposed ina the second housing; wherein when the fast connector and the second connector are mated with each other, the post is inserted into the cavity and actuates said shutter to open by means of engagement with said abutment section.

* * * * *